US011435055B1

(12) United States Patent
Shen

(10) Patent No.: US 11,435,055 B1
(45) Date of Patent: Sep. 6, 2022

(54) ASSEMBLED LAMPSHADE AND VERTICAL LAMP

(71) Applicant: Rongdong Shen, Guangdong (CN)

(72) Inventor: Rongdong Shen, Guangdong (CN)

( * ) Notice: Subject to any disclaimer, the term of this patent is extended or adjusted under 35 U.S.C. 154(b) by 0 days.

(21) Appl. No.: 17/578,452

(22) Filed: Jan. 19, 2022

(30) Foreign Application Priority Data

Nov. 8, 2021 (CN) ..... CN202122724814

(51) Int. Cl.
*F21V 1/14* (2006.01)
*F21V 1/06* (2006.01)
*F21V 17/16* (2006.01)

(52) U.S. Cl.
CPC ..... *F21V 1/143* (2013.01); *F21V 1/06* (2013.01); *F21V 17/168* (2013.01)

(58) Field of Classification Search
CPC ..... F21V 1/06; F21V 1/143; F21V 17/168
See application file for complete search history.

(56) References Cited

U.S. PATENT DOCUMENTS 1,675,514 A * 7/1928 Patterson ..... F21V 1/06 362/350
4,075,684 A * 2/1978 Witz ..... F21V 1/06 362/352
6,746,137 B1 * 6/2004 Yeh ..... F21V 1/06 362/450
11,009,211 B1 * 5/2021 Zhong ..... F21V 1/06
2004/0151000 A1 * 8/2004 Juang ..... F21V 1/06 362/358

FOREIGN PATENT DOCUMENTS

EP 375543 A * 6/1990 ..... F21V 1/06
GB 382103 A * 10/1932
GB 2050591 A * 1/1981 ..... F21V 1/06

* cited by examiner

*Primary Examiner* — Mariceli Santiago
(74) *Attorney, Agent, or Firm* — JCIP Global Inc.

(57) ABSTRACT

The present invention discloses an assembled lampshade. The assembled lampshade includes an upper support, a lower support and a cover body. The upper support and the lower support are respectively arranged at the upper and lower ends of the cover body. The upper support includes a first upper arc ring and a second upper arc ring, the first upper arc ring and the second upper arc ring are semicircular arc rings, the first upper arc ring and the second upper arc ring are connected through a first hinge, and the first upper arc ring and the second upper arc ring are able to be extended in a plane to cooperatively form a circle. The first upper arc ring is provided with a first support rod and a second support rod, and the first support rod and the second support rod are inclined downward.

9 Claims, 6 Drawing Sheets

ASSEMBLED LAMPSHADE AND VERTICAL LAMP

CROSS-REFERENCE TO RELATED APPLICATION

This application claims the priority benefit of China application serial no. 202122724814.8, filed on Nov. 8, 2021. The entirety of the above-mentioned patent application is hereby incorporated by reference herein and made a part of this specification.

BACKGROUND

Technical Field

The present invention belongs to the technical field of lamps, in particular to a lampshade and a vertical lamp which reduces the packaging and transportation volume and is convenient for assembly.

Description of Related Art

The existing vertical lamps are widely used in home, but the volume is still large. Because most lampshades occupy a large space in transportation, the transportation cost is high, the carrying is inconvenient, and they are easy to be damaged and deformed during transportation. Moreover, the installation of lampshade is not convenient enough to meet the higher and higher requirements of industrial design and transportation. Therefore, the prior art needs to be improved.

SUMMARY

The present invention aims to overcome the shortcomings of the prior art. It provides a lampshade convenient for assembly, reduces the packaging volume, saves the transportation cost, and facilitates the assembly of the user at home.

In order to solve the existing technical problems, the present invention adopts the following technical solution.

An assembled lampshade comprises an upper support, a lower support and a cover body, the upper support and the lower support are respectively arranged at an upper end and a lower end of the cover body. The upper support comprises a first upper arc ring and a second upper arc ring, the first upper arc ring and the second upper arc ring are semicircular arc rings, the first upper arc ring and the second upper arc ring are connected through a first hinge, and the first upper arc ring and the second upper arc ring are able to extended in a plane to cooperatively form a circle. The first upper arc ring is provided with a first support rod and a second support rod, the first support rod and the second support rod are inclined downward. An end of the first support rod away from the first upper arc ring is provided with a first connecting rod, and an end of the second support rod away from the first upper arc ring is provided with a second connecting rod. A first mounting ring is arranged below the first upper arc ring, and the plane of the first mounting ring is longitudinally parallel to the plane of the first upper arc ring. An end of the first connecting rod away from the first support rod is arranged on the first mounting ring, and the end of the second connecting rod away from the second support rod is arranged on the first mounting ring. A middle part of the second upper arc ring is provided with a third support rod, the end of the third support rod away from the second upper arc ring is connected with the third connecting rod through a second hinge, and an end of the third connecting rod away from the second hinge is provided with a fourth connecting rod. A second mounting ring is arranged in the middle of the second upper arc ring, the end of the fourth connecting rod away from the third connecting rod is arranged on the second mounting ring, and the fourth connecting rod is parallel to the plane of the second mounting ring.

Further, the lower support comprises a third hinge and a lower arc ring, the lower arc ring is a semicircular arc ring, and the ends of the two lower arc rings are connected through the third hinge. The lower support is a circle when it is extended in a plane.

Further, an inner side of a top end of the cover body is provided with a plurality of upper hooks that can buckle on a ring body of the upper support, an opening of each upper hook faces upward, a hook end of each upper hook faces an inner wall of the cover body, and the extended upper support ring is buckled in a plurality of upper hooks. An inner side of a bottom end of the cover body is provided with a plurality of lower hooks that can buckle on a ring body of the upper support, an opening of the upper hook faces downward, a hook end of each lower hook faces the inner wall of the cover body, and the extended lower support ring is buckled in a plurality of lower hooks.

Further, the cover body is an elongated carrier sheet that can be folded, and left and right butt edges of the carrier sheet are provided with butt joints for connecting the left and right edges. The first support rod and the second support rod are fixedly arranged on the first upper arc ring, and a central angle between the first support rod and the second support rod is 120 degrees. A central angle between the first support rod and a closest end of the first upper arc ring is 30 degrees, and a central angle between the second support rod and a closest end of the first upper arc ring is 30 degrees.

Further, an inclination angle of the first support rod and an inclination angle of the second support rod on the plane where the first upper arc ring is located (the plane of the installed upper support) are acute angles (15~35°). The second connecting rod and the first connecting rod are longitudinally parallel to the plane of the first mounting ring. An obtuse angle (145~165°) is formed between the first support rod and the first connecting rod, and an obtuse angle (145~165°) is formed between the second support rod and the second connecting rod.

Further, the third support rod is fixedly arranged on the second upper arc ring, the third support rod is inclined downward, and an inclination angle of the third support rod on the plane where the second upper arc ring (the upper support plane overturned into a plane) is located is an acute angle (15~35°). After the upper support is overturned into a plane, a central angle between the third support rod and the first support rod is 120 degrees, and a central angle between the third support rod and the second support rod is 120 degrees. An obtuse angle (145~165°) is formed between the fourth connecting rod and the third connecting rod.

Further, the upper support is arranged at a top of the cover body in a plane, the first mounting ring and the second mounting ring are matched and arranged in parallel up and down, the first mounting ring and the second mounting ring are coaxially arranged up and down, and the second connecting rod, the first connecting rod and a connecting part of the first mounting ring are located between the first mounting ring and the second mounting ring, and the fourth connecting rod and a connecting part of the second mounting ring are located between the first mounting ring and the second mounting ring. The connecting part of the first mounting ring and the connecting part of the second mounting ring are arranged inward, and a surface of a non-connecting part of each of the first mounting ring and the second mounting ring is arranged outward.

A vertical lamp includes a base and a plurality of pillars disposed on the base. The vertical lamp further includes the assembled lampshade. The pillar at an upper end is provided with a laterally extending hanging rod, an end of the hanging rod away from the pillar is provided with a lamp holder, a threaded cover is threadedly connected to a bottom of the lamp holder, and a lower part of the lamp holder is provided with a cover body. A bottom end of the lamp holder passes through a coaxial ring of the first mounting ring and the second mounting ring arranged on the cover body and is connected to the threaded cover. The bottom end of the lamp holder is provided with screw teeth matching with the threaded cover. The first mounting ring and the second mounting ring are arranged between the threaded cover and the lamp holder.

Further, a storage plate is arranged under the cover body, and the storage plate is buckled between two adjacent pillars.

By adopting the above technical scheme, the cover body and support of the present invention are placed and packaged separately, which is convenient for disassembly, foldable, easy for packaging and transportation. It can reduce the volume occupied by the lamp cover during packaging, save cost and space, is convenient for transportation.

DESCRIPTION OF THE EMBODIMENTS

Figure 1:
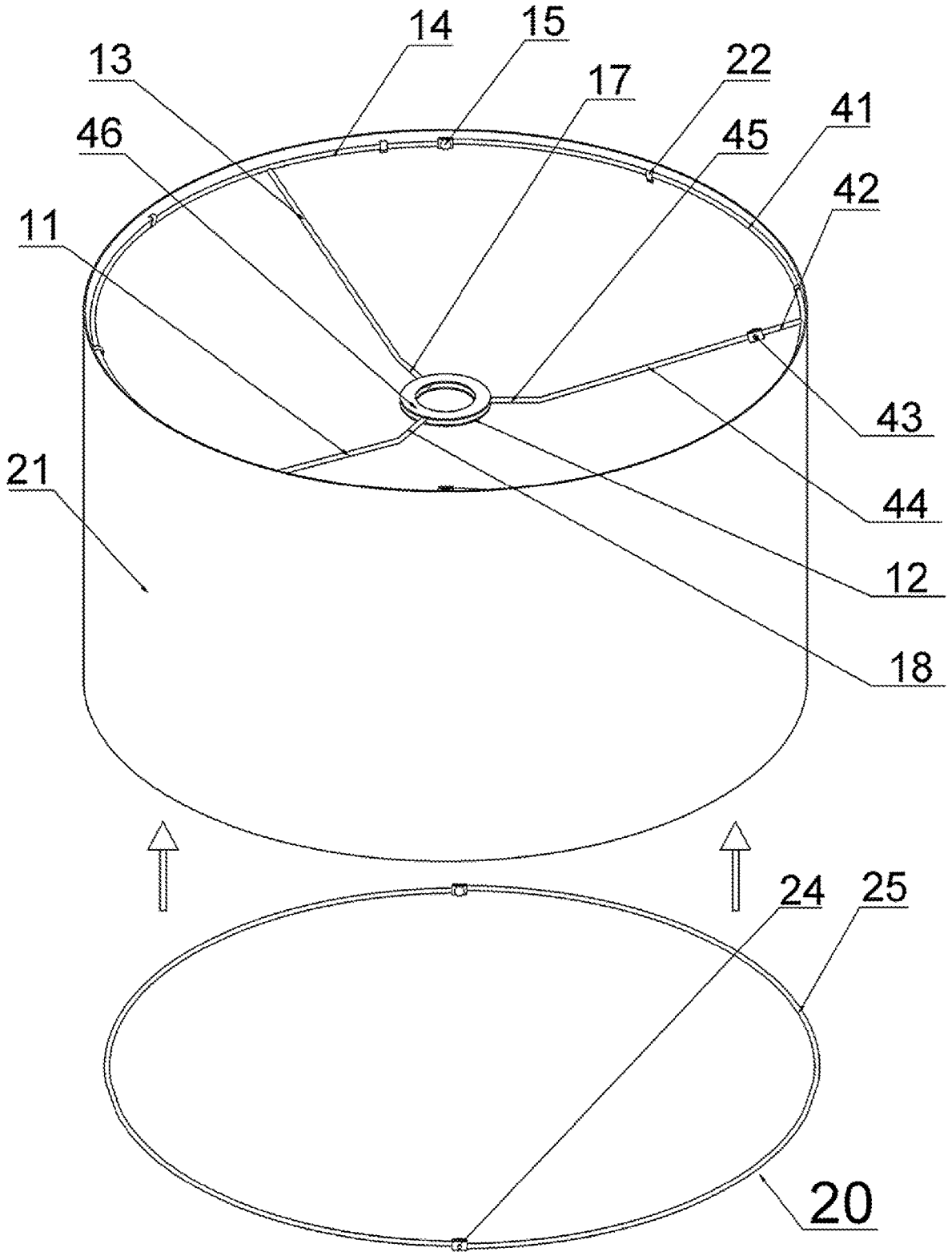
FIG. 1 is a decomposition diagram of an embodiment of a lampshade of the present invention.

In order to further understand the characteristics, technical means, specific objectives and functions of the present invention, and the present invention is further described in detail below in combination with the accompanying drawings and specific embodiments.

As shown in the attached drawings, the present invention includes an upper support 10, a lower support 20 and a cover body 21. The cover body 21 is a long carrier that can be folded. The carrier of the cover body 21 is connected and surrounded in a circle through the butt joint 26 (Velcro, buckle, adhesive piece, etc.) of the butt parts on the left and right sides. The upper support 10 and the lower support 20 are respectively arranged at the upper and lower ends of the cover body 21.

The upper support 10 comprises a first upper arc ring 14 and a second upper arc ring 41, the first upper arc ring 14 and the second upper arc ring 41 are semicircular arc rings, the ends of the first upper arc ring 14 and the second upper arc ring 41 are connected through the first hinge 15, and the first upper arc ring 14 and the second upper arc ring 41 form a circle when they are extended in a plane. The first upper arc ring 14 is provided with a first support rod 11 and a second support rod 13, the first support rod 11 and the second support rod 13 are fixedly arranged on the first upper arc ring 14, and the central angle between the first support rod 11 and the second support rod 13 is 120 degrees.

In one embodiment, the central angle between the first support rod 11 and the closest end of the first upper arc ring 14 is 30 degrees, and the central angle between the second support rod 13 and the closest end of the first upper arc ring 14 is 30 degrees. The first support rod 11 and the second support rod 13 are inclined downward, and the inclination angle of the first support rod 11 and the inclination angle of the second support rod 13 on the plane of the first upper arc ring 14 (the plane of the upper support 10 overturned into a plane) are acute angles (15~35°. The end of the first support rod 11 away from the first upper arc ring 14 is provided with a first connecting rod 18, and the end of the second support rod 13 away from the first upper arc ring 14 is provided with a second connecting rod 17.

A first mounting ring 12 is arranged below the first upper arc ring 14, and the plane of the first mounting ring 12 is longitudinally parallel to the plane of the first upper arc ring 14. The end of the first connecting rod 18 away from the first support rod 11 is arranged on the first mounting ring 12, the end of the second connecting rod 17 away from the second support rod 13 is arranged on the first mounting ring 12, and the second connecting rod 17 and the first connecting rod 18 are longitudinally parallel to the plane of the first mounting ring 12. An obtuse angle (145~165°) is formed between the first support rod 11 and the first connecting rod 18, and an obtuse angle (145~165°) is formed between the second support rod 13 and the second connecting rod 17.

In one embodiment, the middle of the second upper arc ring 41 is provided with a third support rod 42, the third support rod 42 is fixedly arranged on the second upper arc ring 41, the third support rod 42 is inclined downward, and the inclination angle of the third support rod 42 on the plane where the second upper arc ring 41 is located (the plane of the upper support 10 overturned into a plane) is an acute angle (15~35°).

In one embodiment, the end of the third support rod 42 away from the second upper arc ring 41 is connected with the third connecting rod 44 through the third hinge 43, the end of the third connecting rod 44 away from the third hinge 43 is provided with a fourth connecting rod 45, and an obtuse angle (145~165°) is formed between the fourth connecting rod 45 and the third connecting rod 44.

A second mounting ring 46 is arranged in the middle of the second upper arc ring 41, the end of the fourth connecting rod 45 away from the third connecting rod 44 is arranged on the second mounting ring 46, and the fourth connecting rod 45 is parallel to the plane of the second mounting ring 46.

Figure 2:
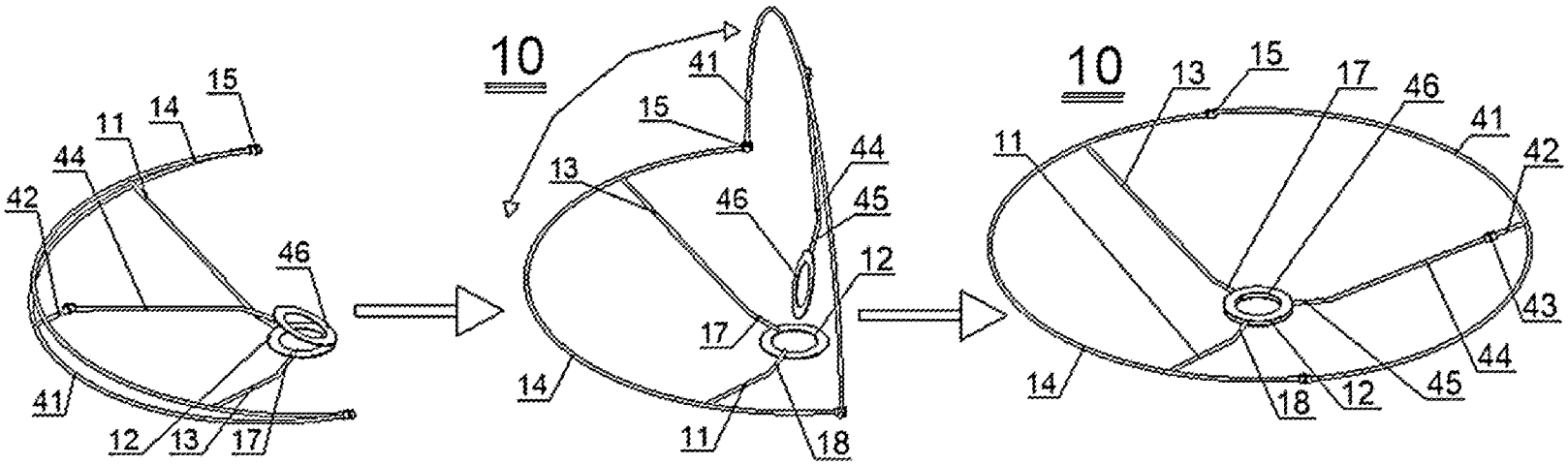
FIG. 2 is an installation diagram of a upper support part of the lampshade embodiment of the present invention.

In one embodiment, the upper support 10 is assembled on the top of the cover body 21 after turning into a plane, the first mounting ring 12 and the second mounting ring 46 are matched and arranged in parallel up and down, and the planes of the first mounting ring 12 and the second mounting ring 46 are parallel to the plane of the circular upper support 10 (the plane of the upper support 10 in which the first upper arc ring 14 and the second upper arc ring 41 overturn into a plane). The first mounting ring 12 and the second mounting ring 46 are arranged coaxially up and down, the second connecting rod 17, the first connecting rod 18 and the connecting part of the first mounting ring 12 are located between the first mounting ring 12 and the second mounting ring 46, and the fourth connecting rod 45 and the connecting part of the second mounting ring 46 are located between the first mounting ring 12 and the second mounting ring 46. The connecting part of the first mounting ring 12 and the connecting part of the second mounting ring 46 are arranged inward, and the surface of the non-connecting part between the first mounting ring 12 and the second mounting ring 46 is arranged outward. After the upper support 10 is overturned into a plane, the central angle between the third support rod 42 and the first support rod 11 is 120 degrees. The central angle between the third support rod 42 and the second support rod 13 is 120 degrees. Refer to FIG. 2 for the extension diagram of the upper support 10.

Figure 4:
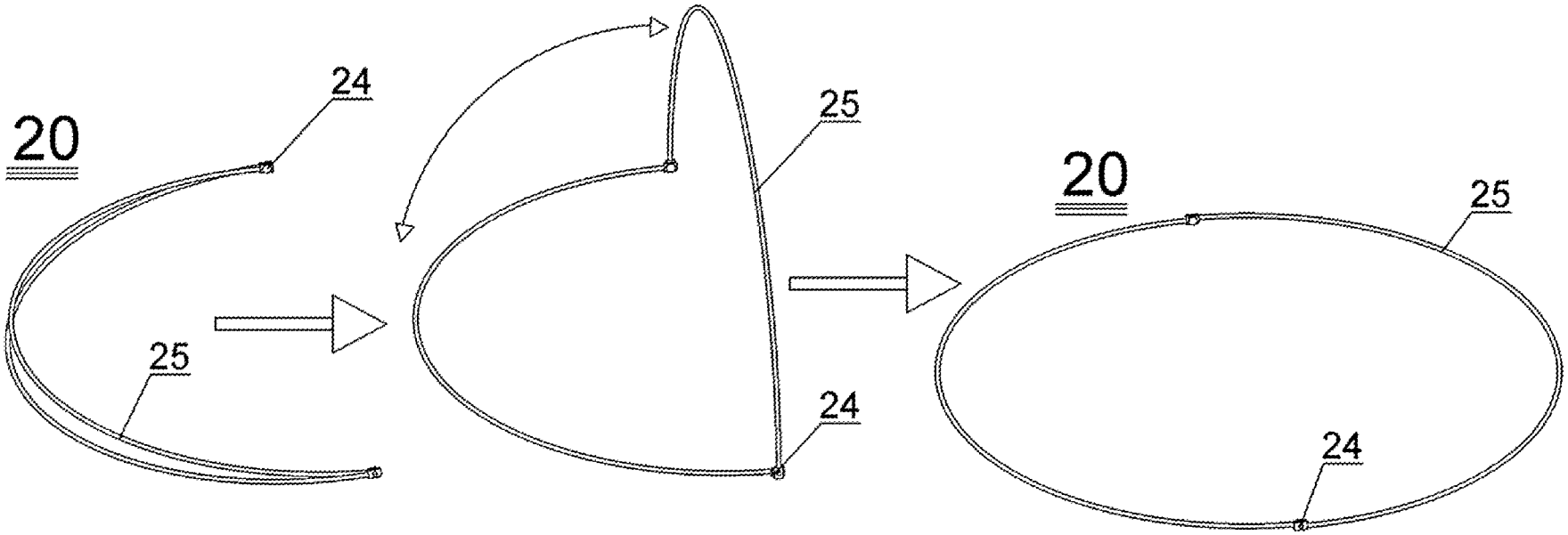
FIG. 4 is an installation diagram of a lower support part of the lampshade embodiment of the present invention.

The lower support 20 comprises a second hinge 24 and a lower arc ring 25, the lower arc ring 25 is a semicircular arc ring, and the ends of the two lower arc rings 25 are connected through the second hinge 24. The lower support 20 is a circle when it is extended in a plane. Refer to FIG. 4 for the extension diagram of the lower support 20.

The upper support 10 and the lower support 20 can be folded for storage, which is convenient for packaging and transportation.

Figure 3:
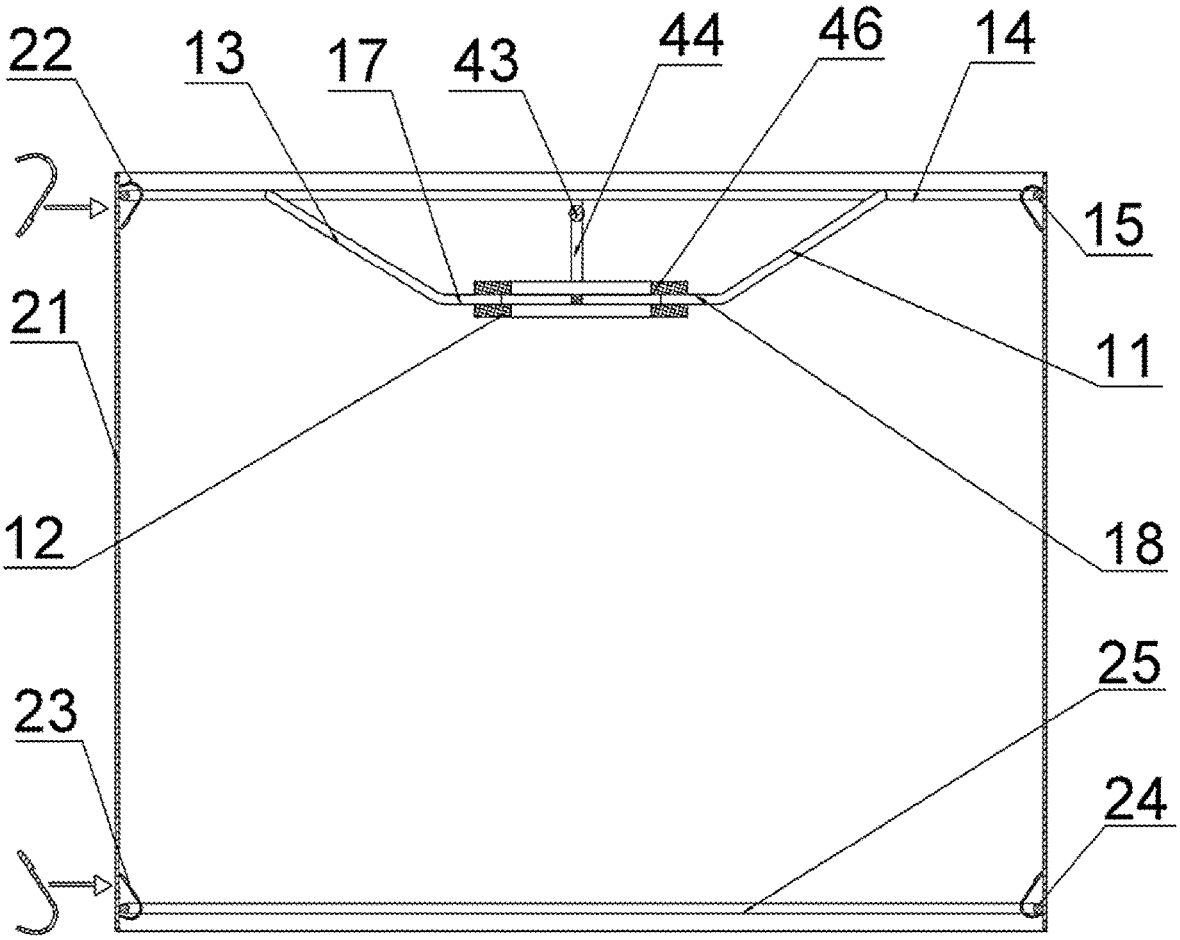
FIG. 3 is a structural diagram of the embodiment of the lampshade of the present invention.
Figure 5:
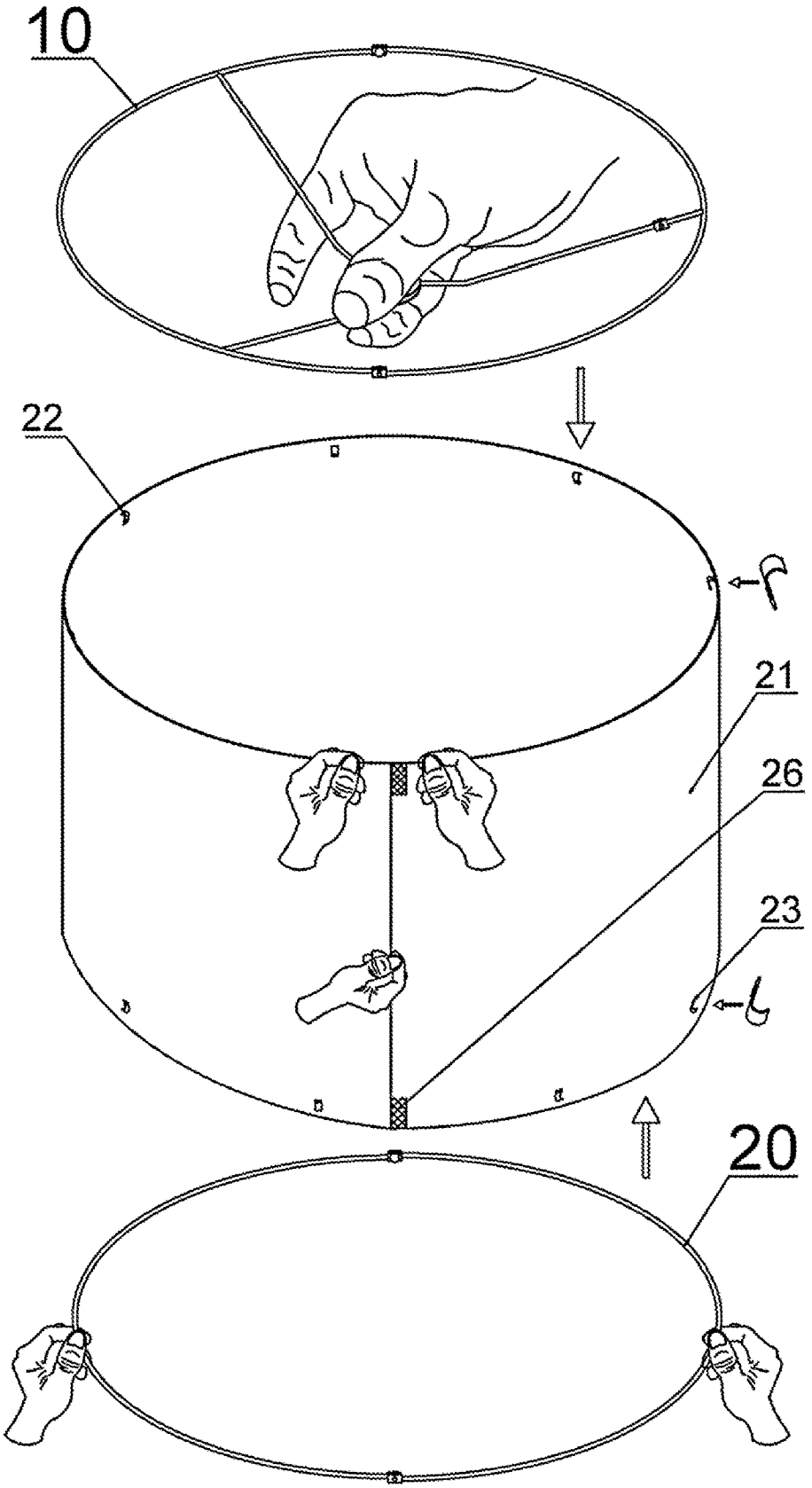
FIG. 5 is an assembly diagram of the embodiment of the lampshade of the present invention.
Figure 6:
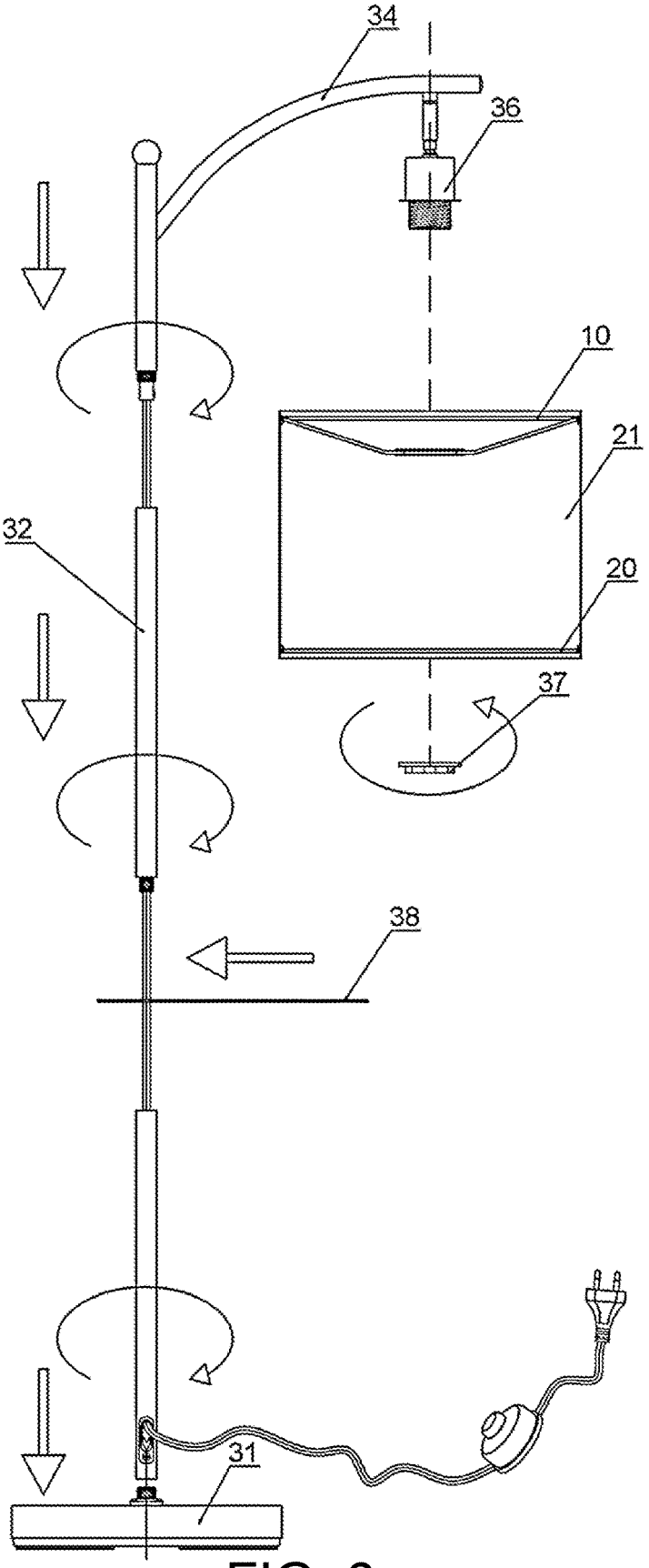
FIG. 6 is a schematic diagram of a vertical lamp of the present invention.

In one embodiment, the inner side of the top end of the cover body 21 is provided with a plurality of upper hooks 22 that can buckle the upper support 10 ring body, the opening of the upper hook 22 is upward, the hook end of the upper hook 22 faces the inner wall of the cover body 21 (refer to the enlarged schematic part on the side of FIG. 3 and FIG. 5), and the open upper support 10 ring body is buckled in a plurality of upper hooks 22.

The inner side of the bottom end of the cover body 21 is provided with a plurality of lower hooks 23 that can buckle the lower support 20 ring body, the opening of the lower hook 23 is downward, the hook end of the lower hook 23 faces the inner wall of the cover body 21 (refer to the enlarged schematic part on the side of FIG. 3 and FIG. 5), and the open lower support 20 ring body is buckled in a plurality of lower hooks 23.

A vertical lamp comprises a base 31. A plurality of pillars 32 are arranged on the base 31. The pillar 32 at the top is provided with a laterally extending hanging rod 34, and the end of the hanging rod 34 away from the pillar 32 is provided with a lamp holder 36. The bottom of the lamp holder 36 is provided with a threaded cover 37 matched with it, and the lower part of the lamp holder 36 is provided with a cover body 21. The first mounting ring 12 and the second mounting ring 46 are arranged coaxially up and down. The bottom end of the lamp holder 36 passes through the coaxial ring of the first mounting ring 12 and the second mounting ring 46 arranged on the cover body 21 and is connected to the threaded cover 37. The bottom end of the lamp holder 36 is provided with screw teeth matching with the threaded cover 37, and the first mounting ring 12 and the second mounting ring 46 are fixed on the lamp holder 36 through the threaded cover 37. The cover body 21 is suspended on the lamp holder 36, and a storage plate 38 is arranged under the cover body 21, which is buckled between two adjacent pillars 32.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An assembled lampshade, comprising an upper support, a lower support, and a cover body, wherein the upper support and the lower support are respectively arranged at an upper end and a lower end of the cover body; wherein the upper support comprises a first upper arc ring and a second upper arc ring, the first upper arc ring and the second upper arc ring are semicircular arc rings, the first upper arc ring and the second upper arc ring are connected through a first hinge, and the first upper arc ring and the second upper arc ring are able to be extended in a plane to cooperatively form a circle; the first upper arc ring is provided with a first support rod and a second support rod, and the first support rod and the second support rod are inclined downward;

an end of the first support rod away from the first upper arc ring is provided with a first connecting rod, and an end of the second support rod away from the first upper arc ring is provided with a second connecting rod;

a first mounting ring is arranged below the first upper arc ring, and a plane of the first mounting ring is longitudinally parallel to a plane of the first upper arc ring; an end of the first connecting rod away from the first support rod is arranged on the first mounting ring, and an end of the second connecting rod away from the second support rod is arranged on the first mounting ring;

a middle part of the second upper arc ring is provided with a third support rod, an end of the third support rod away from the second upper arc ring is connected to the third connecting rod through a second hinge, and an end of the third connecting rod away from the second hinge is provided with a fourth connecting rod;

the middle part of the second upper arc ring is provided with a second mounting ring, an end of the fourth connecting rod away from the third connecting rod is arranged on the second mounting ring, and the fourth connecting rod is parallel to a plane of the second mounting ring.

2. The assembled lampshade according to claim 1, wherein the lower support comprises a third hinge and two lower arc rings, each lower arc ring is a semicircular arc ring, and ends of the two lower arc rings are connected through the third hinge; the lower support is a circle when being extended in a plane.

3. The assembled lampshade according to claim 1, wherein an inner side of a top end of the cover body is provided with a plurality of upper hooks that is able to buckle on a ring body of the upper support, an opening of each upper hook faces upward, a hook end of each upper hook faces an inner wall of the cover body, and the extended upper support ring is buckled in a plurality of upper hooks;

an inner side of a bottom end of the cover body is provided with a plurality of lower hooks that is able to buckle a ring body of the lower support, an opening of each lower hook faces downward, a hook end of each lower hook faces the inner wall of the cover body, and the extended lower support ring is buckled in a plurality of lower hooks.

4. The assembled lampshade according to claim 1, wherein the cover body is an elongated carrier sheet that is foldable, and left and right butt edges of the carrier sheet are provided with butt joints for connecting the left and right edges; the first support rod and the second support rod are fixedly arranged on the first upper arc ring, and a central angle between the first support rod and the second support rod is 120 degrees;

a central angle between the first support rod and a closest end of the first upper arc ring is 30 degrees, and a central angle between the second support rod and a closest end of the first upper arc ring is 30 degrees.

5. The assembled lampshade according to claim 1, wherein an inclination angle of the first support rod and an inclination angle of the second support rod on the plane where the first upper arc ring is located are acute angles;

the second connecting rod and the first connecting rod are longitudinally parallel to the plane of the first mounting ring; an obtuse angle is formed between the first support rod and the first connecting rod, and an obtuse angle is formed between the second support rod and the second connecting rod.

6. The assembled lampshade according to claim 1, wherein the third support rod is fixedly arranged on the second upper arc ring, the third support rod is inclined downward, and an inclination angle of the third support rod on the plane where the second upper arc ring is located is an acute angle;

after the upper support is overturned into a plane, a central angle between the third support rod and the first support rod is 120 degrees; a central angle between the third support rod and the second support rod is 120 degrees;

an obtuse angle is formed between the fourth connecting rod and the third connecting rod.

7. The assembled lampshade according to claim 1, wherein the upper support is arranged at a top of the cover body in a plane, the first mounting ring and the second mounting ring are matched and arranged in parallel up and down, the first mounting ring and the second mounting ring are coaxially arranged up and down, and the second connecting rod, the first connecting rod and a connecting part of the first mounting ring are located between the first mounting ring and the second mounting ring, and the fourth connecting rod and a connecting part of the second mounting ring are located between the first mounting ring and the second mounting ring;

the connecting part of the first mounting ring and the connecting part of the second mounting ring are arranged inward, and a surface of a non-connecting part of each of the first mounting ring and the second mounting ring is arranged outward.

8. A vertical lamp, comprising a base and a plurality of pillars disposed on the base, the vertical lamp further comprising the assembled lampshade according to claim 1, wherein the pillar at an upper end is provided with a laterally extending hanging rod, an end of the hanging rod away from the pillar is provided with a lamp holder, a threaded cover is threadedly connected to a bottom of the lamp holder, and a lower part of the lamp holder is provided with the cover body, a bottom end of the lamp holder passes through a coaxial ring of the first mounting ring and the second mounting ring arranged on the cover body and is connected to the threaded cover, the bottom end of the lamp holder is provided with screw teeth matching with the threaded cover, and the first mounting ring and the second mounting ring are arranged between the threaded cover and the lamp holder.

9. The vertical lamp according to claim 8, wherein a storage plate is arranged under the cover body, and the storage plate is buckled between two adjacent pillars.

* * * * *